US006621229B2

(12) United States Patent
Kanazawa et al.

(10) Patent No.: US 6,621,229 B2
(45) Date of Patent: Sep. 16, 2003

(54) PLASMA DISPLAY PANEL AND DRIVING METHOD TO PREVENT ABNORMAL DISCHARGE

(75) Inventors: Yoshikazu Kanazawa, Kawasaki (JP); Shirun Ho, Tokyo (JP); Keizo Suzuki, Kodaira (JP)

(73) Assignees: Hitachi, Ltd., Tokyo (JP); Fujitsu Hitachi Plasma Display Ltd., Kanagawa-ken (JP)

( * ) Notice: Subject to any disclaimer, the term of this patent is extended or adjusted under 35 U.S.C. 154(b) by 0 days.

(21) Appl. No.: 09/917,828

(22) Filed: Jul. 31, 2001

(65) Prior Publication Data

US 2002/0093291 A1 Jul. 18, 2002

(30) Foreign Application Priority Data

Jan. 17, 2001 (JP) ..... 2001-009168

(51) Int. Cl.[7] ..... G09G 3/28

(52) U.S. Cl. ..... 315/169.3; 315/169.4; 345/66; 345/68

(58) Field of Search ..... 315/169.3, 169.4, 315/169.1; 345/60, 66, 68, 67

(56) References Cited

U.S. PATENT DOCUMENTS 6,084,558 A * 7/2000 Setoguchi et al. ..... 345/60

FOREIGN PATENT DOCUMENTS

| | | |
|---|---|---|
| JP | 2692692 | 9/1997 |
| JP | 2801893 | 7/1998 |
| WO | 2000-501199 | 2/2000 |

* cited by examiner

*Primary Examiner*—David Vu
(74) *Attorney, Agent, or Firm*—Mattingly, Stanger & Malur, P.C.

(57) ABSTRACT

A discharge is initiated in a cell in which an address discharge is conducted at a first timing T1 in a charge adjustment period. Next, at a second timing T2, a discharge is initiated for adjusting a wall charge in a cell where a charge remains therein because the address discharge does not occurred. Thus, some negative charges are formed in an X electrode and a Y electrode, thus preventing a false discharge from occurring in an unselected cell.

16 Claims, 14 Drawing Sheets

ADDRESS ELECTRODE
0V
Va

X1 ELECTRODE
0V
Vx
−Vwx
Vs

Y1 ELECTRODE
0V
Vw
−Vy
−Vey
Vs

X2 ELECTRODE
0V
Vx
−Vwx
Vx
Vs

Y2 ELECTRODE
0V
Vw
−Vy
−Vey
−Vy
Vs
RESET PERIOD
ADDRESS PERIOD
SUSTAIN DISCHARGE PERIOD

PLASMA DISPLAY PANEL AND DRIVING METHOD TO PREVENT ABNORMAL DISCHARGE

BACKGROUND OF THE INVENTION

1. Field of the Invention

The present invention relates to a plasma display panel and a driving method thereof.

2. Description of the Related Art

A plasma display panel includes two glass substrates having electrodes formed thereon, with a gap of about 100 microns therebetween that is filled with a discharge mixture gas containing Ne, Xe, or the like. A voltage that is equal to or greater than the break down voltage (of the discharge gas) is applied between the electrodes to cause a discharge giving a UV radiation, which excites and illuminates phosphors provided on the substrate, thereby displaying an image.

FIG. 7 is a diagram illustrating a general structure of a plasma display panel device.

On a display panel 10, first electrodes (X electrodes) 11 and second electrodes (Y electrodes) 12 are formed so as to be disposed in parallel to each other. Third electrodes (address electrodes) 13 are formed so as to cross perpendicularly to the first and second electrodes. A first driving circuit 14 supplies a voltage pulse to the first electrodes 11, a second driving circuit 15 supplies a voltage pulse to the second electrodes 12, and a third driving circuit 16 supplies a voltage pulse to the third electrodes 13. The first and second electrodes 11 and 12, are provided to initiate a sustain discharge for display illumination. The sustain discharge occurs when the voltage pulse is applied repeatedly between the first and second electrodes 11 and 12. In addition, one of the first and second electrodes 11 and 12 functions as a scan electrode (Y electrode) for writing display data. The third electrode 13, on the other hand, is a electrode for selecting a display cell to be illuminated, and applies to a selected cell a voltage for initiating a writing discharge between the third electrode 13 and one of the first electrode 11 and second electrode 12. The first, second and third driving circuits 14, 15 and 16 are for generating voltage pulse relative to purposes of the first, second and third electrodes 11, 12 and 13.

FIG. 8 is a plan view illustrating a display panel portion of the device shown in FIG. 7. The X electrode as the first electrode and the Y electrode as the second electrode are disposed parallel to each other. In this figure, electrodes for display lines L1 to L5 are shown. Moreover, the address electrode as the third electrode (A1 to A4) and ribs 2 for dividing discharge cells are formed. The panel 10 has the X electrode and the Y electrode as display electrodes alternatively disposed at a constant interval so as to use all gaps between electrodes as display lines (L1, L2 . . . ). Such method is called ALIS method (Alternate Lighting of Surfaces) and disclosed in Japanese Patent No. 2801893. Because all of the gaps between electrodes are used as the display line, a number of electrodes can be a half of that in a plasma display panel having a structure as shown in FIG. 14. Therefore, it is an advantageous method in terms of cost reduction and higher definition.

FIG. 9 is a diagram illustrating a luminescence principle of a plasma display panel using the ALIS method. In the ALIS method, two display lines share one electrode, and thus, an upper line and a lower line sharing a common electrode cannot be illuminated at the same time. Therefore, similar to an interlaced display in a TV receiver, a display of odd-numbered lines (a first field) and a display of even-numbered lines (a second field) are done alternatively in a time-division manner.

FIG. 10 is a diagram illustrating a structure of sub-fields in a driving method of a plasma display panel using the ALIS method. As shown in the figure, one frame is composed of a first and a second fields dividing inside thereof. Moreover, each field is divided by a plurality of sub-fields. The plasma display panel is either discharged or not-discharged. Therefore, difference in brightness, i.e., gradation, is controlled by a number of discharges. For the above-mentioned reason, the frame includes a plurality of sub-fields each corresponding to a different number of discharges. Thus, by selectively discharging the sub-field to be illuminated according to the gradation, different brightness can be achieved. Generally, 8 to 12 sub-fields are provided.

Furthermore, each sub-field includes a reset period 21, an address period 22, and a sustain discharge period 23 (also called as a sustain period). The reset period 21 conducts an operation to reset all the cells in a uniform state, e.g., a state in which wall charge is eliminated, regardless of an illumination state of the previous sub-field. In order to decide ON/OFF state of the cell according to display data, the address period 22 selectively discharges (i.e., initiate an address discharge) to form the wall charge to put the cell in ON state. The sustain discharge period 23 emits predetermined light by repeating discharges in the cell in which the address discharge has occurred.

FIGS. 11A to 11E illustrate waveform diagrams of driving waveforms each being applied to each electrode in a plasma display panel employing the ALIS method. FIG. 11A shows a pulse supplied to the address electrode; FIG. 11B shows a pulse supplied to an X1 electrode; FIG. 11C shows a pulse supplied to a Y1 electrode; FIG. 11D shows a pulse supplied to an X2 electrode; and FIG. 11E shows a pulse supplied to a Y2 electrode. First, during the reset period, in order to eliminate an excessive wall charge of a cell that has been illuminated in the previous sub-field, a fine pulse −Vy of 1 $\mu$s and about −170V is applied to the Y electrode. With the pulse −Vy, excessive wall charges between the address electrode and the Y electrode are eliminated. Next, a pulse of about −120V (−Vwx) having a gentle gradient waveform is applied to the X electrode. With the pulse −Vwx, the wall charge is eliminated between the address electrode and the X electrode and between X and Y electrodes of the cell that has been illuminated in the previous sub-field and. Then, a writing pulse (Vw) of about 170V having a gentle gradient waveform is applied to the Y electrode. With the pulse Vw, a writing discharge occurs between the Y electrode and the address electrode, and between the Y electrode and the X electrode to form a certain degree of wall charge. In addition, while a voltage of about 90V (Vx) is applied to the X electrode, an elimination pulse (−Vey) of about −160V having a gentle gradient waveform is applied to the Y electrode. Thus, the wall charge formed the instant preceding thereof is eliminated, and some new wall charges having a reversed polarity are formed. Through all operations described above, all the cells become electrically uniform to be prepared for a next address period. The wall charge of the last phase of the reset period is such that a few positive charges are formed in the Y electrode and a few negative charges are formed in the X electrode. It should be understood that in the figure, Va represents an address pulse, −Vy represents a scan pulse, and Vs represents a sustain pulse.

According to the ALIS method, in odd-numbered fields, lines are illuminated between the X1–Y1 electrodes, X2–Y2 electrodes, X3–Y3 electrodes and so on. In the even-numbered fields, lines are illuminated between Y1–X2 electrodes, Y2–X3 electrodes, Y3–X4 electrodes and so on. Consequently, during the address period, the address pulse is applied to the address electrode, whereas in the address period of the odd-numbered field the scan pulse is applied to Y1, Y2 . . . Yn electrodes. During the address period, in the even-numbered field, the scan pulse is applied to the X2, X3 . . . Xn electrodes. During the sustain discharge period in the odd-numbered field, the sustain pulse is applied to X1–Y1 electrodes, X2–Y2 electrodes, X3–Y3 electrodes, and so on, so that an addressed cell is illuminated. During the sustain discharge period in the even-numbered field, the sustain pulse is applied to Y1–X2 electrodes, Y2–X3 electrodes, Y3–X4 electrodes and so on, so that an addressed cell is illuminated.

FIGS. 12A to 12F show waveform diagrams of voltages applied to a plasma display panel during the sustain discharge period. FIG. 12A is a waveform diagram of a voltage applied to the X1 electrode; FIG. 12B is a waveform diagram of a voltage applied to the Y1 electrode; FIG. 12C is a waveform diagram of a voltage applied to the X2 electrode; FIG. 12D is a waveform diagram of a voltage applied to the Y2 electrode; FIG. 12E is a waveform diagram of a voltage applied to the X3 electrode; and FIG. 12F is a waveform diagram of a voltage applied to the Y3 electrode. Black dots represent discharge positions of a discharge by a display line defined by the X2 electrode and the Y2 electrode. In this case, in order to prevent generation of a discharge between the Y1 and X2 electrodes and between the Y2 and X3 electrodes, each electrode is applied with a wide pulse.

FIG. 14 is a diagram illustrating a general configuration of other plasma display panel in general. An X electrode and a Y electrode are paired up to form one display line.

FIGS. 15A to 15C show driving waveforms for driving a plasma display panel shown in FIG. 14, in which, FIG. 15A shows a waveform applied to the address electrode; FIG. 15B shows a waveform applied to the X electrode; and FIG. 15C shows a waveform applied to the Y electrode. The driving waveform is based on the disclosure of Japanese Patent No. 2692692 but with a modification to the reset period waveform, and is disclosed in Japanese Translation of Unexamined PCT Application from other countries No. 2000-501199. The driving method is characterized in that during the reset period, a wall charge superimposed by an address pulse remains between the address electrode and the Y electrode. Therefore, it is possible to lower voltage of the address pulse and a scan pulse applied during the address period.

FIGS. 13A to 13D are diagrams illustrating operation of a plasma display panel using the ALIS method as shown in FIGS. 8 to 12F. FIG. 13A shows a state in which a sustain discharge is repeatedly initiated between the X2 electrode and the Y2 electrode. During that time, as shown in FIG. 13B, electrons generated by the sustain discharge are accumulated as a wall charge as it moves toward adjacent the Y1 electrode or the X3 electrode. Electrons have greater mobility than ions, and thus diffusion toward adjacent cells is easy to occur. On the other hand, ions have less mobility so that accumulation in the adjacent cell does not occur. The amount of charge to be stored increases as the interval between electrodes decrease, as the applied voltage increases, and as the number of times sustain discharge is repeated increases. When the amount of accumulation exceeds certain point, a discharge is initiated between the X1 and Y1 electrodes as shown in FIG. 13C, and thereafter, the sustain discharge occurs repeatedly by the sustain discharge pulse as shown in FIG. 13D.

Moreover, even if the wall charge does not remain during the reset period, an abnormal discharge may occur when the interval between electrodes are narrow, the applied voltages high, and a number of the repetition of the sustain discharge large.

Furthermore, similar phenomenon occurs in the plasma display panel shown in FIGS. 14 and 15C.

FIGS. 16A to 16C show diagrams illustrating operation of the plasma display panel as shown in FIGS. 14 and 15A to 15C. FIG. 16A shows a state of a wall charge after the reset period and before entering the address period. As previously shown, the wall charge, that is advantageous for an address discharge, remains. FIG. 16B shows a state in which the address discharge is initiated in a cell of the X2 electrode and the Y2 electrode. FIG. 16C shows a state during the sustain discharge period. It shows that the cell between the X1 electrode and the Y1 electrode starts the discharge because of a priming effect or the like of illuminating cells by repeating the sustain discharges. The wall charge formed during the reset period in the present method is advantageous for the address discharge, but may be affect disadvantageously for the sustain discharge period. Particularly, the phenomenon tends to occur in a high definition panel having small intervals between electrodes, and in a case where driving is performed while a large amount of wall charges remain during the reset period.

SUMMARY OF THE INVENTION

An object of the present invention is to solve the above-described problems, and to provide a plasma display panel and a driving method thereof which prevents an abnormal discharge from generating in a cell in which an address discharge is not occurred, the cell adjacent to a cell in which the address discharge is conducted and a sustain discharge is initiated.

According to the present invention, a reset discharge is conducted before an address period to eliminate a wall charge or to make a predetermined amount of wall charge remain therein. After the address discharge is selectively conducted during the address period, a discharge is initiated in a cell in which the address discharge does not occur so as to adjust an amount or a polarity of the wall charge.

Moreover, according to the present invention, in reset step before the address period, negative charges are formed in an X electrode and a Y electrode, thus avoiding an abnormal discharge.

The present invention will be described in detail below.

According to a first aspect, in a driving method of a plasma display panel, the plasma display panel includes a plurality of first electrodes, a plurality of second electrodes disposed alternately and parallel to the first electrode, and a plurality of third electrodes disposed perpendicularly to the first and the second electrodes so as to provide intervals. The method includes: a step for resetting; a step for address discharging; a step for sustain discharging; and a charge adjustment step for adjusting a wall charge for a cell having no address discharges occurred therein by applying a voltage for initiating a discharge between the third electrode and one of the first and the second electrodes in the cell having no address discharges occurred therein during either one of a period for the reset step, a period for the address step, and a period for the sustain discharge step. In addition, a small amount of negative charges are accumulated in a vicinity of the first and the second electrodes in the cell having no address discharges occurred therein.

According to a second aspect, in a driving method of a plasma display panel, the plasma display panel includes a plurality of first electrodes, a plurality of second electrodes disposed alternately and parallel to the first electrode, and a plurality of third electrodes disposed perpendicularly to the first and the second electrodes so as to provide intervals. The method includes: a reset step; an address discharge step; and a sustain discharge step; wherein a charge adjustment step is provided for adjusting a wall charge for a cell having no address discharges occurred therein by applying a voltage for initiating a discharge between the third electrode and one of the first and the second electrodes in the cell having no address discharges occurred therein.

In the second aspect, the sustain discharge is occurred one time in a cell in which the address discharge is initiated in the address step, and the charge adjustment step is initiated thereafter.

In the second aspect, the charge adjustment step applies a voltage to initiate a discharge in the cell in which the address discharge does not occur caused by the use of the third electrode as a cathode and either one of the first and the second electrodes as an anode. Moreover, in the charge adjustment step, another one of first and second electrodes has a voltage that does not initiate a discharge between the address electrode and the one of the first and the second electrodes.

In the second aspect, in the charge adjustment step, a polarity between the first and the second electrodes is a reversed polarity of a waveform that initiates a discharge between the first and the second electrode at the end of the reset step.

In the second aspect, the charge adjustment step is provided in at least one of a plurality of sub-fields within a field or a frame. Alternatively, the charge adjustment step is provided in a sub-field having a large number of times of sustain discharge. Another alternative is that the charge adjustment step is provided in the first sub-field in the field.

In the second aspect, the voltage for initiating the discharge between the third electrode and the one of the first and second electrodes in the charge adjustment step has a voltage waveform having gentle gradient. Moreover, electrons are formed on both the first and the second electrode in the charge adjustment step.

In a third aspect, in a driving method of a plasma display panel, the plasma display panel comprises a plurality of first electrodes, a plurality of second electrodes disposed alternately and parallel to the first electrode, and a plurality of third electrodes disposed perpendicularly to the first and the second electrodes so as to provide intervals. The method includes: a reset step; an address discharge step; a sustain discharge step; wherein, a charge adjustment step is provided in the reset step so that electrons remain both of the first electrode side and the second electrode side.

In a fourth aspect, a plasma display panel includes: a plurality of first electrodes, a plurality of second electrodes disposed alternately and parallel to the first electrode, and a plurality of third electrodes disposed perpendicularly to the first and the second electrodes so as to provide intervals. A driving circuit is provided to conduct a reset step, an address discharge step, and a charge adjustment step and a sustain discharge step for adjusting a wall charge with respect to a cell, in which the address discharge is not conducted, by applying a voltage which initiates s discharge between the third electrode and one of the first electrode and the second electrode.

In a fifth aspect, the plasma display panel includes: a plurality of first electrodes, a plurality of second electrodes disposed alternately and parallel to the first electrode, and a plurality of third electrodes disposed perpendicularly to the first and the second electrodes so as to provide intervals. A driving circuit is provided for driving a reset and charge adjustment step for making electrons remain in both of the first electrodes and the second electrodes, an address discharge step, and a sustain discharge step.

These and other objects, features and advantages of the invention will be apparent from the following more particular description of preferred embodiments of the invention, as illustrated in the accompanying drawings.

DETAILED DESCRIPTION OF THE PREFERRED EMBODIMENTS

In the following, several embodiments of the present invention will be described with reference to drawings.

Figure 1A:
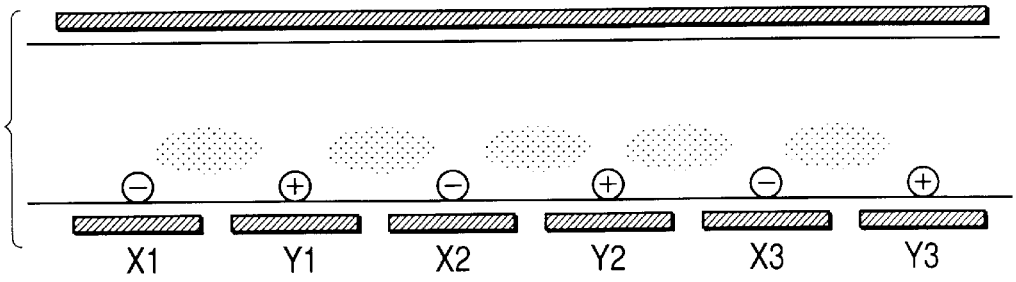
FIGS. 1A to 1D show diagrams illustrating principles of a driving method of a plasma display panel according to the present invention.
Figure 1B:
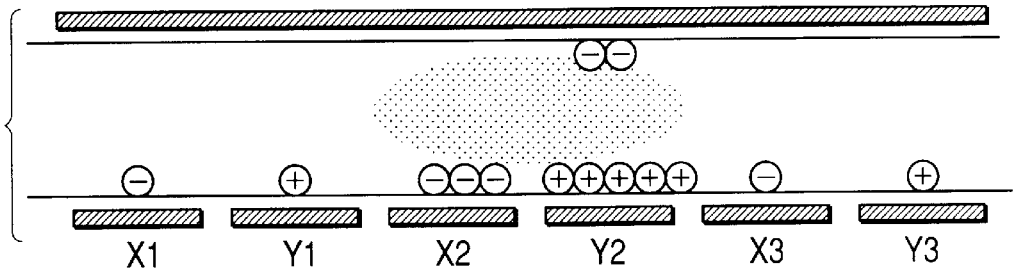
Figure 1C:
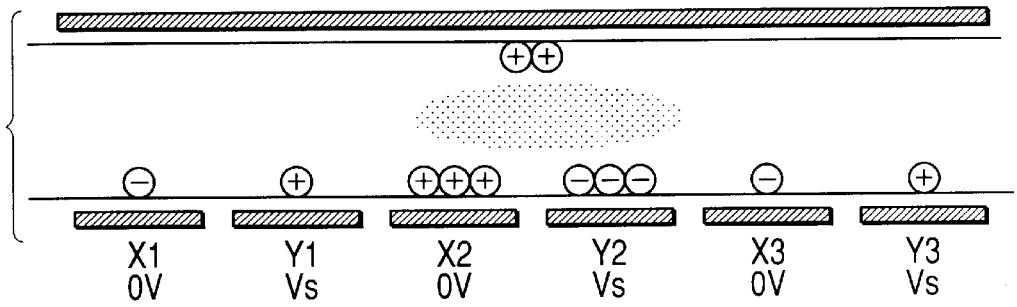
Figure 1D:
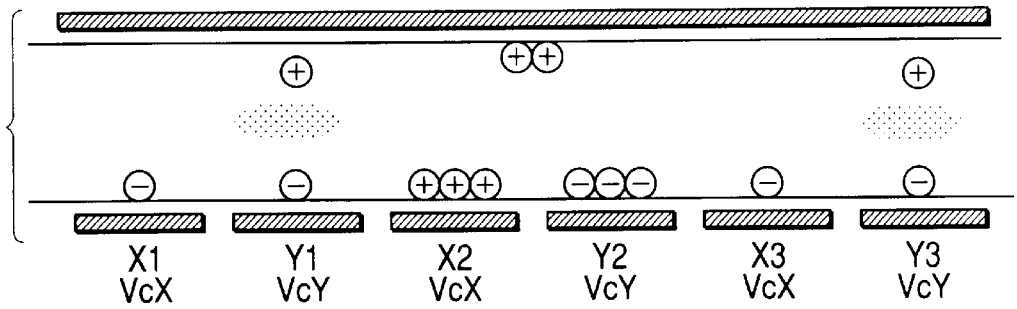

FIGS. 1A to 1D show diagrams illustrating a principle of a driving method of a plasma display panel according to the present invention. FIG. 1A illustrates a state of a wall charge after a reset period according to a driving waveform as shown in FIGS. 11A to 11E, and a few negative charges remain in X1, X2, and X3 electrodes while a few positive charges remain in Y1, Y2 and Y3 electrodes. FIG. 1B illustrates a state of a wall charge after an address discharge occurred in a discharge cell between the X2 electrode and the Y2 electrode. Negative wall charges are accumulated in X2 electrode while positive wall charges are accumulated in Y2 electrode. FIG. 1C illustrates a state in which a sustain discharge is initiated one time after the address discharge. Positive wall charges are accumulated in the X2 electrode while negative wall charges are accumulated in the Y2 electrode. In this state, a few negative wall charges remain in both of the X1 electrode and the X3 electrode, and a few positive wall charges remain in both of the Y1 electrode and the Y3 electrode. FIG. 1D illustrates a state in which a discharge is initiated by applying a voltage pulse between the address electrode used as a cathode and the Y electrodes used as an anode, and polarities of wall charges of the Y1 electrodes and Y3 electrode are reversed to be negative wall charges. In an unselected cell, when both of the X electrode and the Y electrode form some negative wall charges (electrons), the amount of charges coming from the sustain discharge decreases, the sustain discharge being initiated repeatedly in adjacent cells thereafter, thus eliminating abnormal discharges. A step illustrated in FIGS. 1C and 1D is provided by the present invention. Hereinafter, the step is referred as a charge adjustment step, and a period in which the charge adjustment step is performed is referred as a charge adjustment period.

Figure 2:
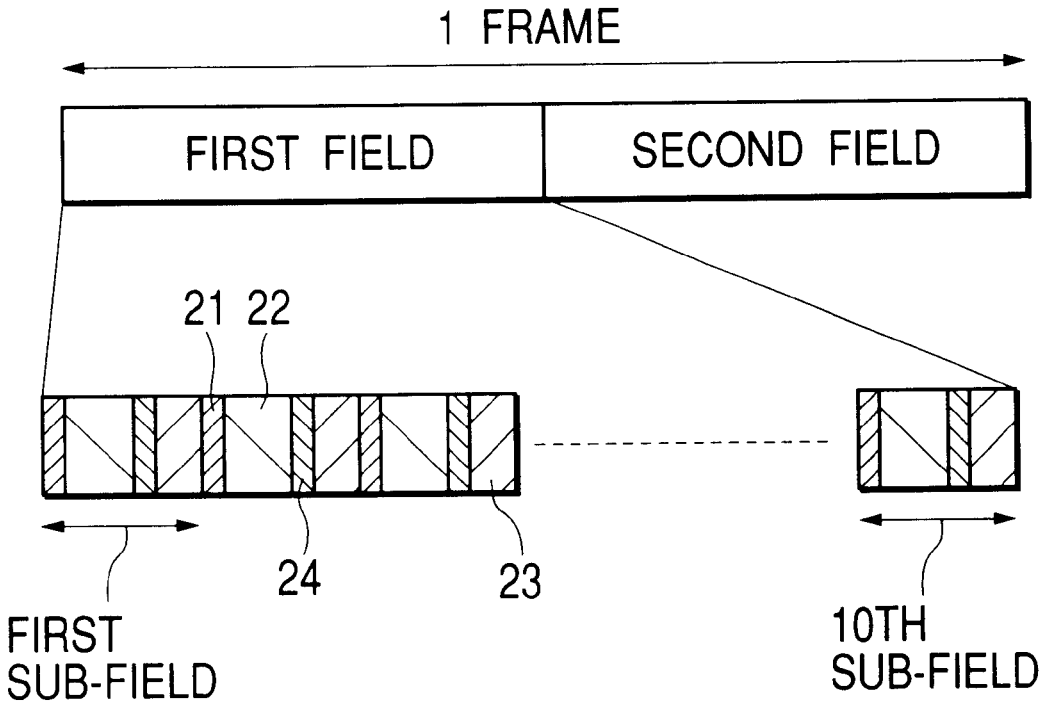
FIG. 2 is a diagram illustrating a structure of a sub-field for a purpose of illustrating the driving method of the plasma display panel according to the present invention.

FIG. 2 illustrates a structure of a sub-field for a purpose of explaining a driving method of a plasma display panel of the present invention. As shown in the figure, after the address period 22, the charge adjustment period 24 is provided to adjust an amount of wall charges and a polarity thereof of non-illuminated cell. The charge adjustment period 24 may be added to all the sub-fields. Alternatively, it may be added to sub-fields having a large number of times of sustain discharges.

Figures 3A, 3B, 3C, 3D, 3E:
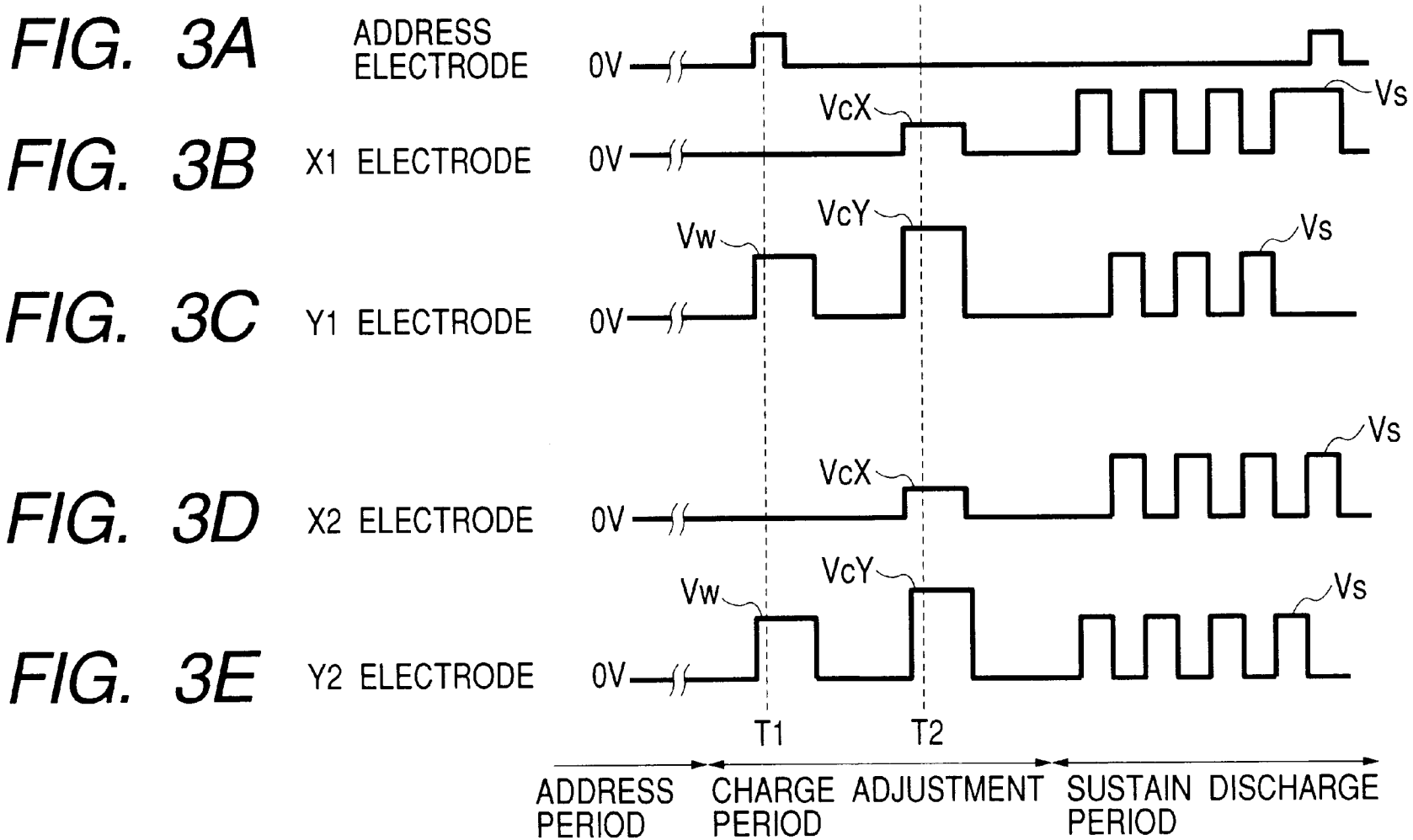
FIGS. 3A to 3E illustrate waveform diagrams of a driving method of a plasma display panel according to a first embodiment of the present invention.

FIGS. 3A to 3E illustrate waveform diagrams showing a driving method for a plasma display panel according to a first embodiment of the present invention. FIG. 3A is a waveform of a voltage applied to the address electrode; FIG. 3B is a waveform of a voltage applied to the X1 electrode; FIG. 3C is a waveform of a voltage applied to the Y1 electrode; FIG. 3D is a waveform of a voltage applied to the X2 electrode; and FIG. 3E is a waveform of a voltage applied to the Y2 electrode. From the reset period to the address period, voltages having waveforms as shown in FIGS. 11A to 11E are applied. It is characterized in that waveforms for charge adjustment are applied after the address period. When a discharge is initiated to a cell in which the address discharge occurred at T1 in the charge adjustment period, the wall charge of each electrode becomes as is shown in FIG. 1C. At a timing of T2, a discharge for the wall charge adjustment is initiated to a cell in which the address discharge is not initiated and a charge remains. When the address electrode is in 0V (GND), pluses VcX and VcY are applied to the X electrode and the Y electrode, respectively. The VcY is a voltage applied between the address electrode and the Y electrode, and its value is set to generate a weak discharge, i.e., 190V. Moreover, the voltage VcX applied to the X electrode is to reduce a potential difference between electrodes so as not to generate any discharge between the address electrode and the Y electrode, and its value is set to 90V. Due to the discharge at the timing of T2, a few negative charges are formed on the Y electrode as shown in FIG. 1D. Therefore, negative charges are accumulated in both X and Y electrodes in the unselected cell, so that any more of electron is prevented from coming or accumulating, thus enabling to prevent a false discharge.

Figures 4A, 4B, 4C, 4D, 4E:
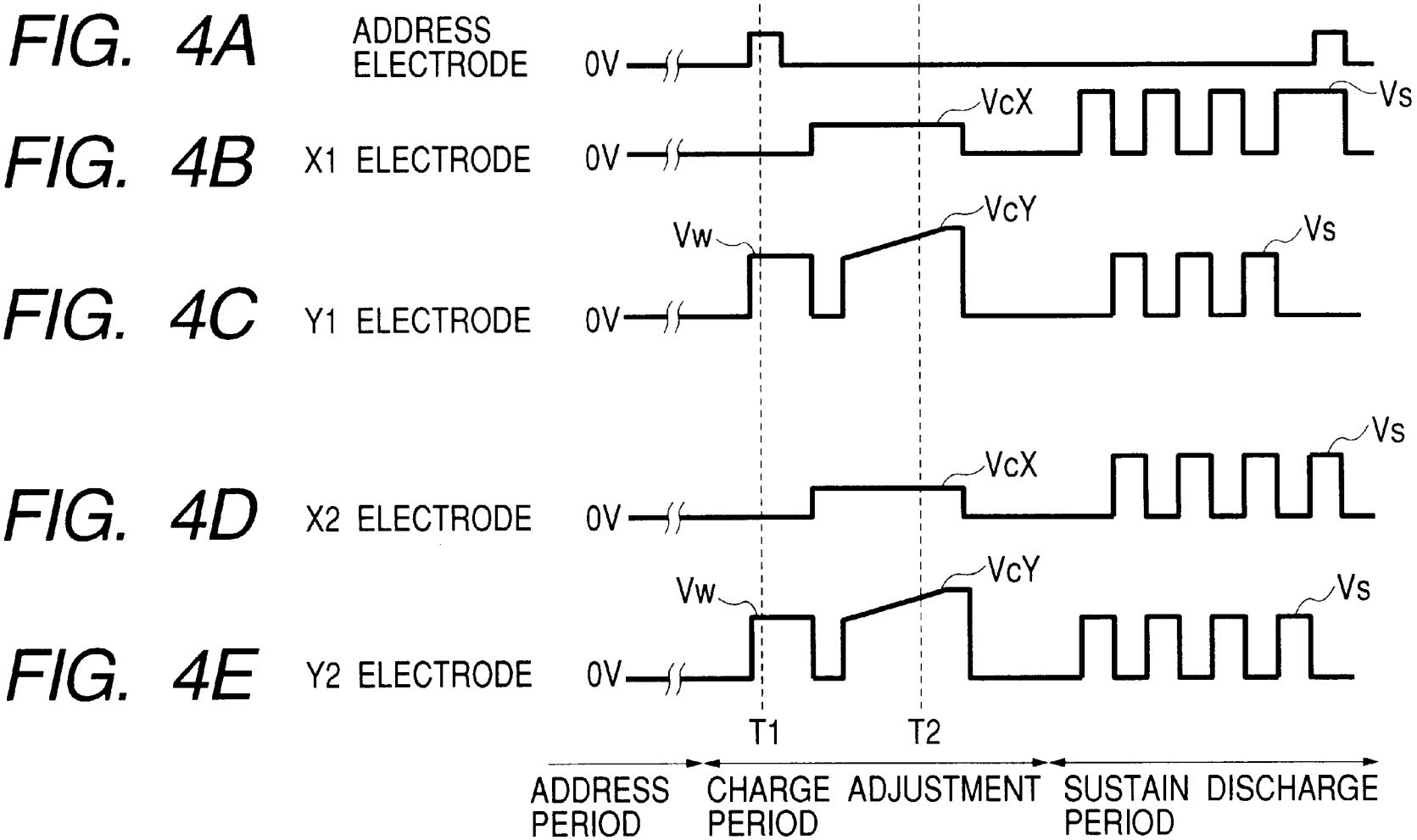
FIGS. 4A to 4E illustrate waveform diagrams of a driving method of a plasma display panel according to a second embodiment of the present invention.

FIGS. 4A to 4E show waveform diagrams of a driving method of a plasma display panel according to a second embodiment of the present invention, in which, FIG. 4A shows a waveform of a voltage applied to the address electrode during the charge adjustment period and the sustain discharge period; FIG. 4B shows a waveform of a voltage applied to the X1 electrode during the charge adjustment period and the sustain discharge period; FIG. 4C shows a waveform of a voltage applied to the Y1 electrode during the charge adjustment period and the sustain discharge period; FIG. 4D shows a waveform of a voltage applied to the X2 electrode during the charge adjustment period and the sustain discharge period; and FIG. 4E shows a waveform of a voltage applied to the Y2 electrode during the charge adjustment period and the sustain discharge period.

In the present embodiment, a voltage waveform VcY having gentle gradient is used as a pulse for the charge adjustment applied at the timing T2 in order to form a few negative charges in the Y electrode. The waveform VcY is characterized in that duration of the voltage application is from 50 $\mu$s to 100 $\mu$s. When compared to the previous embodiment, the duration is considerably longer, but no strong discharge would occur at one time because of a gentle gradient in a voltage relative to a change in time. Therefore, even if charge accumulation states are different in each cell, a few negative charges are securely formed on the Y electrode. Values of the voltages VcX and VcY are the same as that in the previous embodiment.

Figures 5A, 5B, 5C:
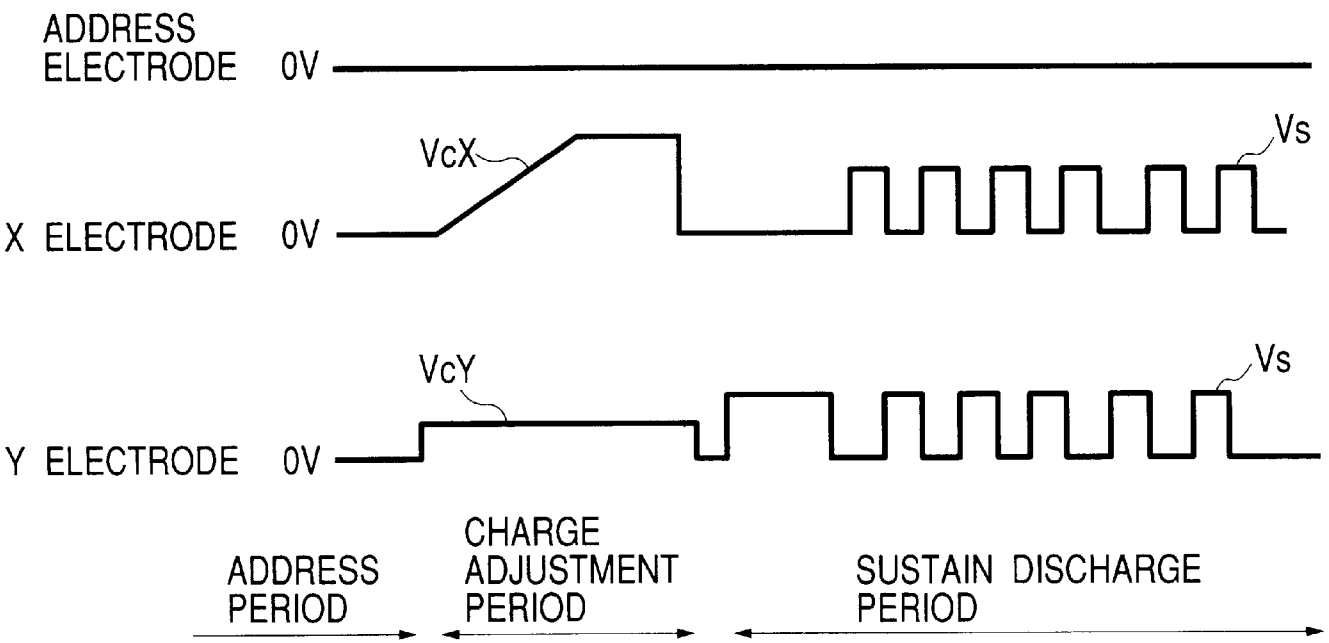
FIGS. 5A to 5C illustrate waveform diagrams of a driving method of a plasma display panel according to a third embodiment of the present invention.

FIGS. 5A and 5C show waveform diagrams of a driving method of a plasma display panel according to a third embodiment of the present invention in which, FIG. 5A shows a waveform of a voltage applied to the address electrode during the voltage adjustment period and the sustain discharge period; FIG. 5B shows a waveform of a voltage applied to the X electrode during the voltage adjustment period and the sustain discharge period; and FIG. 5C shows a waveform of a voltage applied to the Y electrode during the voltage adjustment period and the sustain discharge period.

Figure 14:
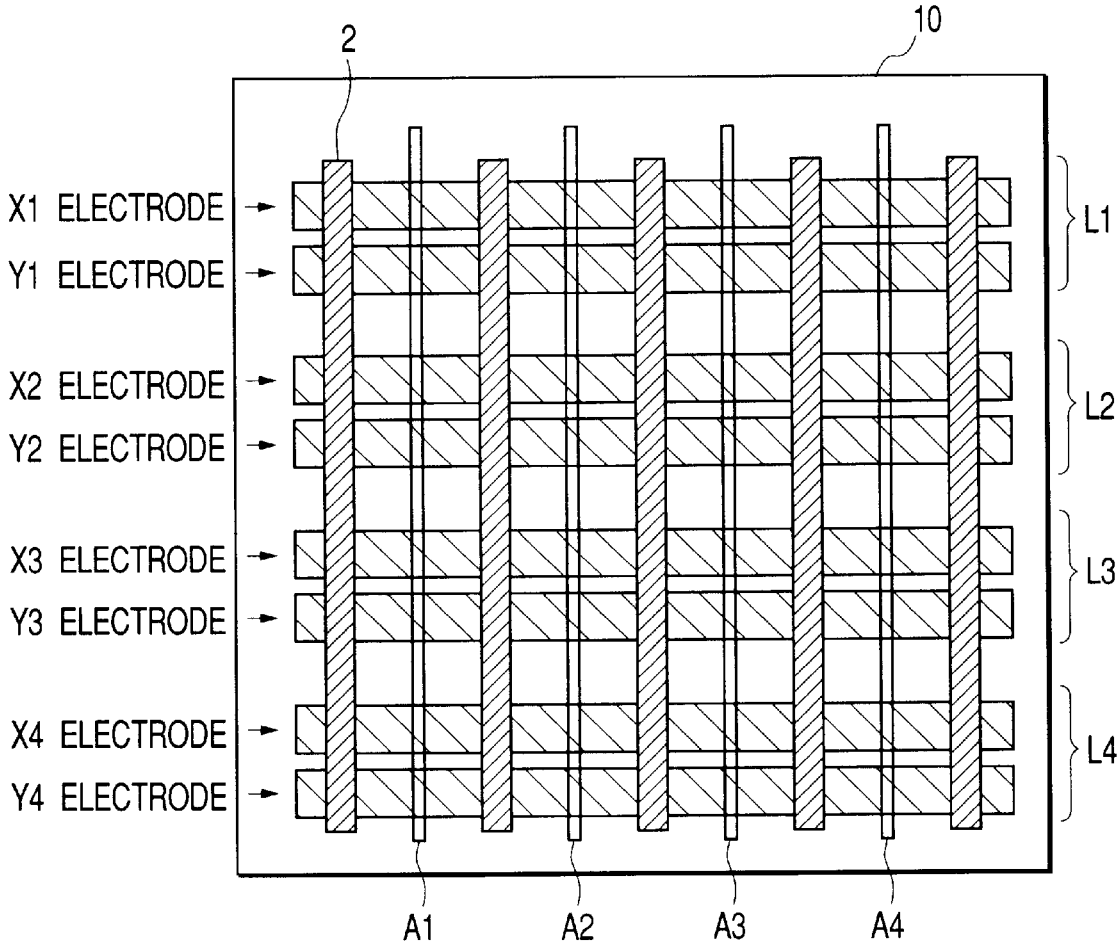
FIG. 14 is a diagram illustrating a general structure of another common plasma display panel.
Figures 15A, 15B, 15C:
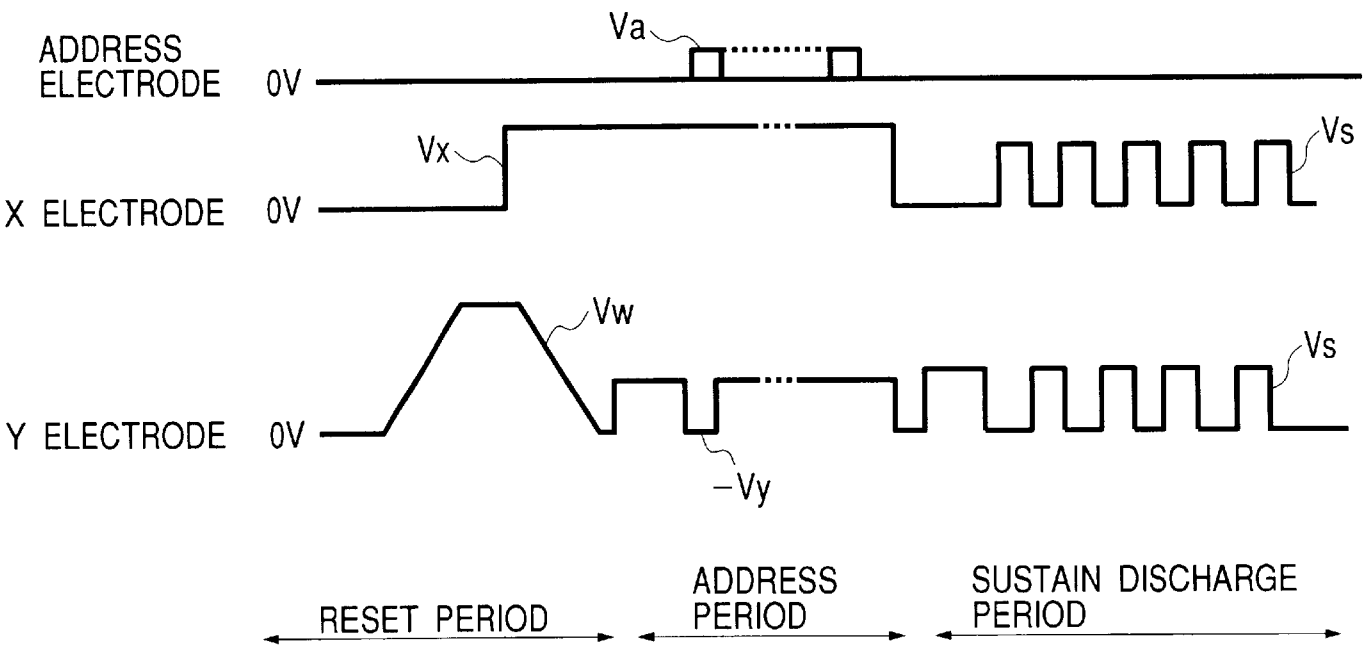
FIGS. 15A to 15C illustrate waveform diagrams for driving the plasma display panel shown in FIG. 14.
Figure 16A:
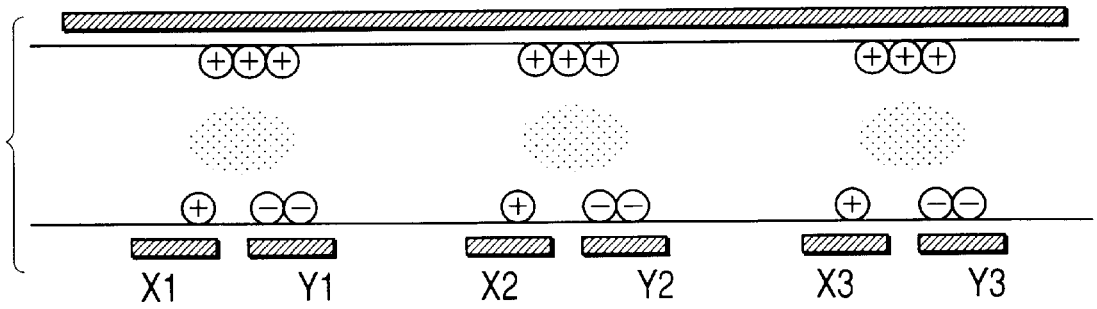
FIGS. 16A to 16C show diagrams illustrating operation of the plasma display panel shown in FIG. 14 being driven by the driving waveforms shown in FIGS. 15A to 15C.
Figure 16B:
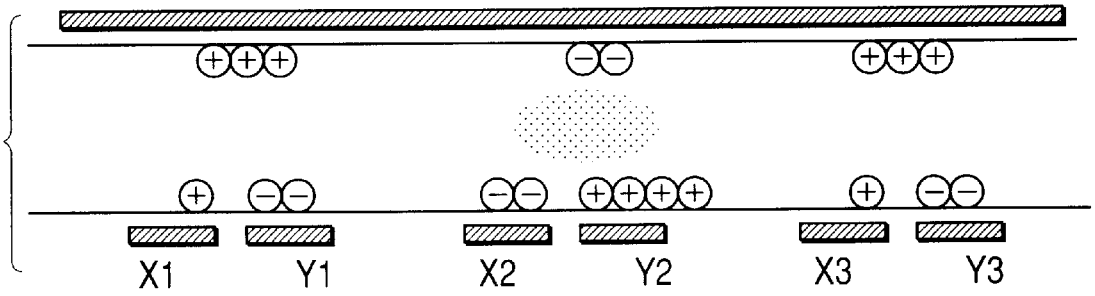
Figure 16C:
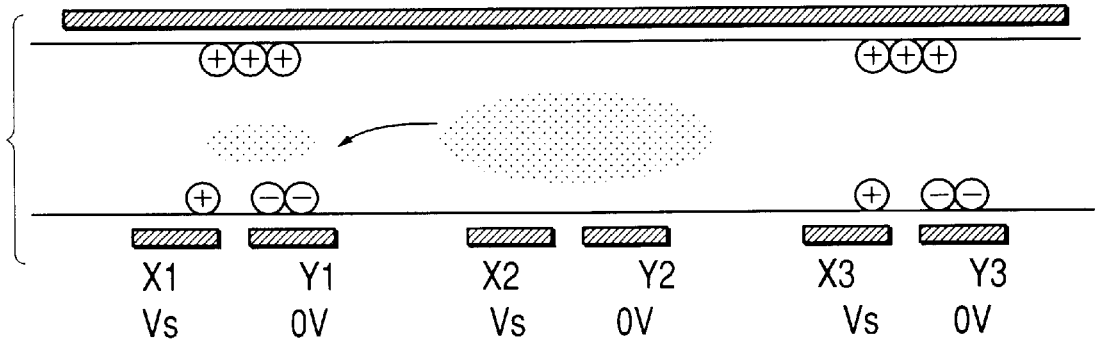

A driving method according to the present embodiment is applied to a common plasma display panel as shown in FIGS. 14 to 16. From the reset period to the address period, the voltage waveforms are the same as shown in FIGS. 15A to 15C. The driving method is characterized in that a wall charge advantageous to the address discharge remains. Thus, in a cell in which the address charge did not occur, a negative charge is formed on a Y electrode side while a positive charge is formed on an X electrode side. The X electrode is applied with a voltage waveform VcX having gentle gradient, and a discharge is initiated between the address electrode and the X electrode, so that the negative charge is formed on the X electrode side. By doing so, both X and Y electrodes have negative wall charges formed thereon, thus preventing an abnormal discharge from occurring. It should be understood that the voltage waveform VcX is a voltage of about 200V including a voltage of the wall charge formed by the reset discharge, which initiates a predetermined discharge between the address electrode and the X electrode. Moreover, a voltage waveform VcY applied to the Y electrode is a voltage which prevents a discharge between the X electrode and the Y electrode in a cell in which the address discharge is not initiated. Therefore, the voltage waveform VcY is higher than 0V and lower than the sustain voltage waveform Vs to prevent a discharge in the cell in which the address discharge occurred, i.e., it is about 100V.

Figures 6A, 6B, 6C, 6D, 6E:
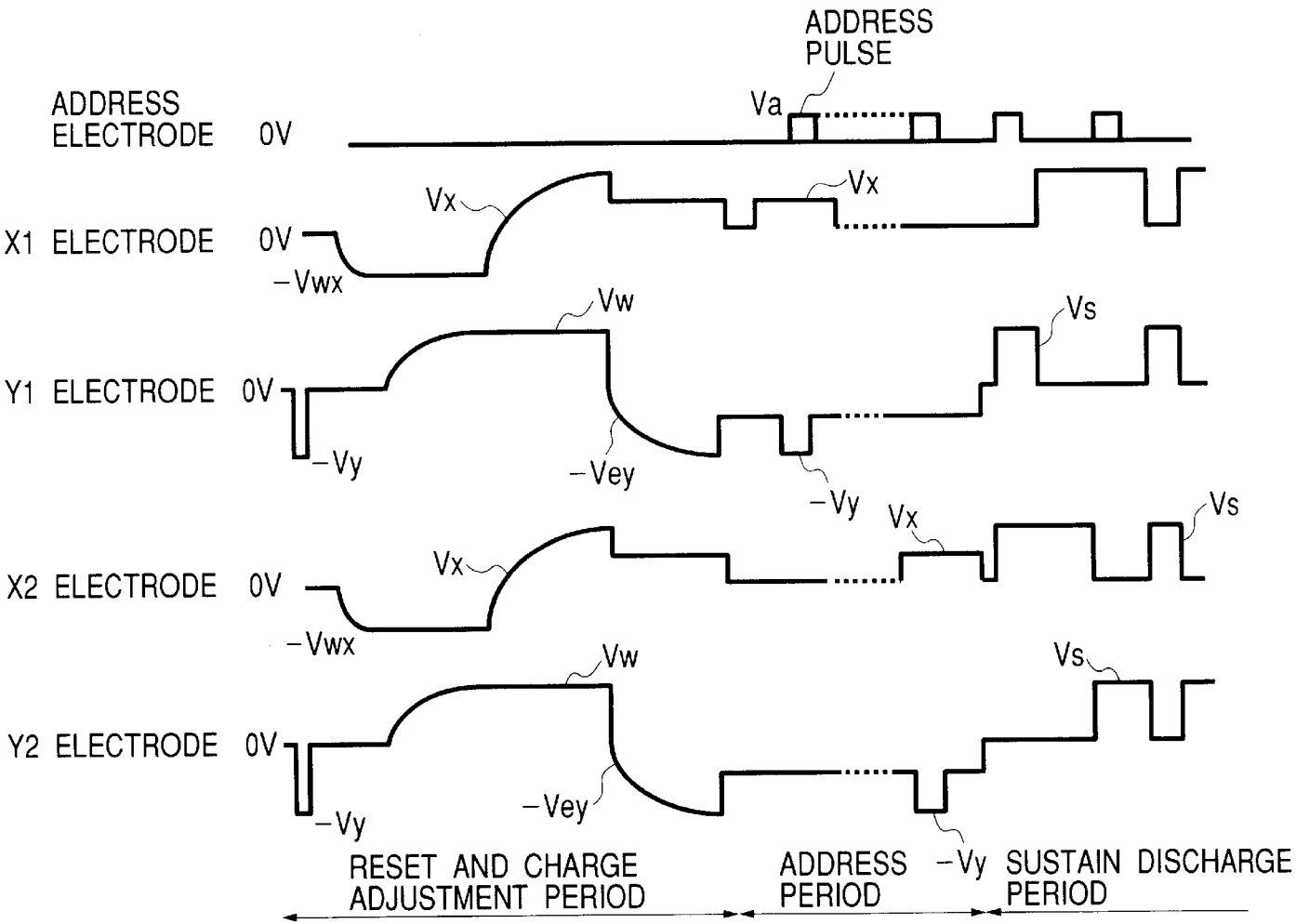
FIGS. 6A to 6E illustrate waveform diagrams of a driving method of a plasma display panel according to a fourth embodiment of the present invention.
Figure 7:
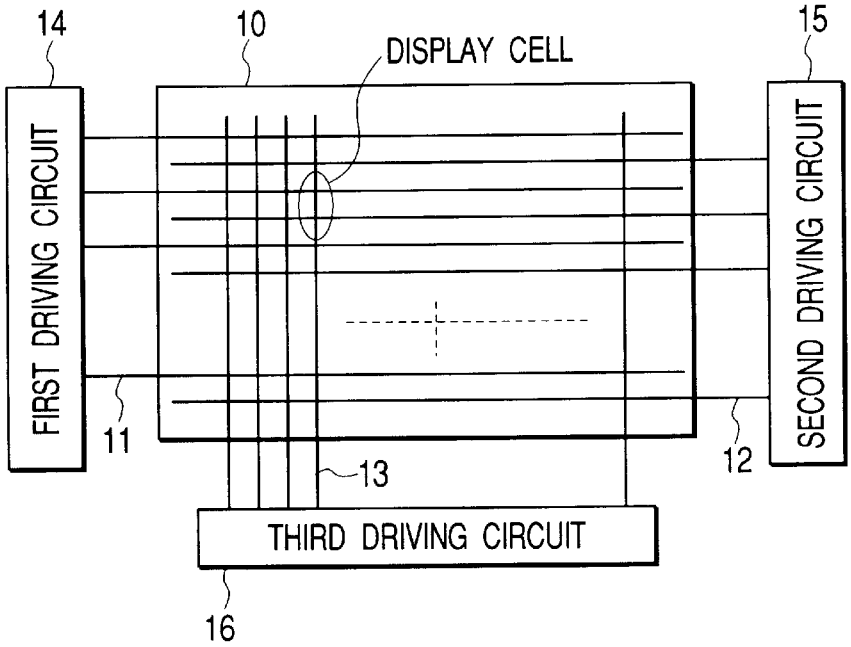
FIG. 7 is a diagram illustrating a general structure of a plasma display device.
Figure 8:
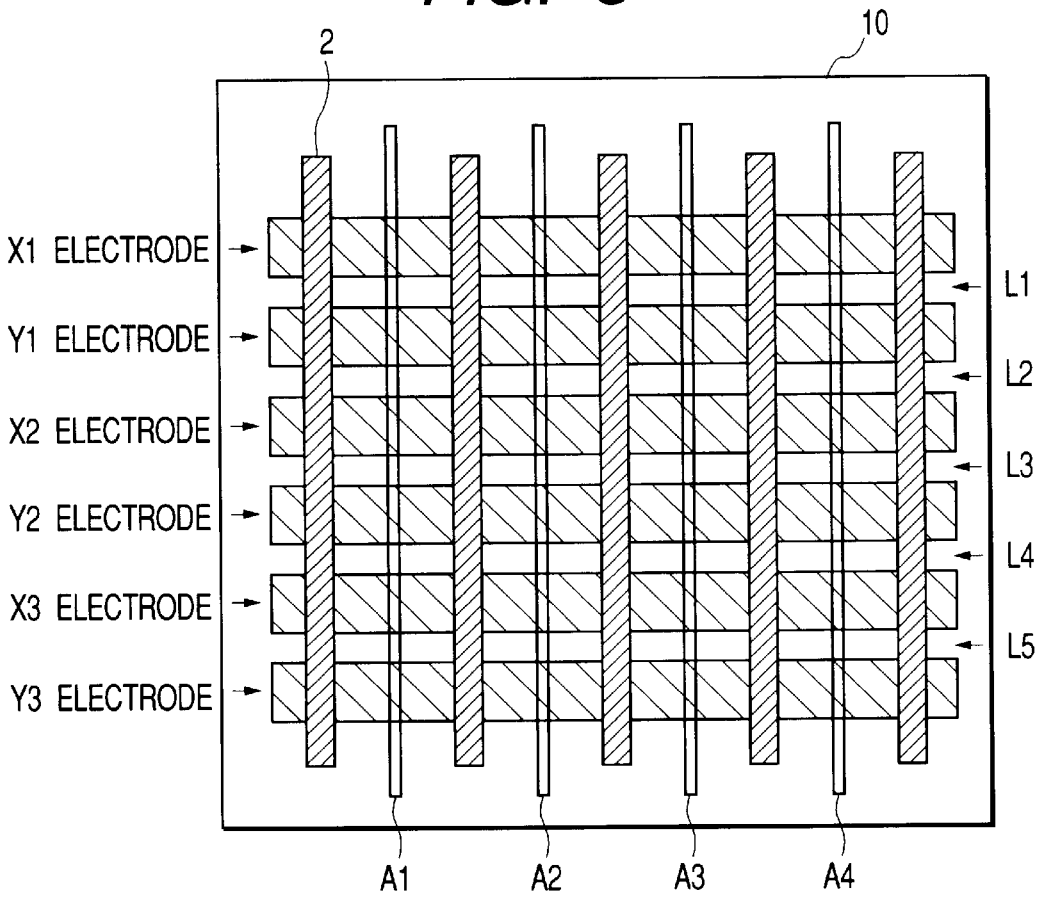
FIG. 8 is a plan view illustrating a display panel portion of the device shown in FIG. 7.
Figure 9:
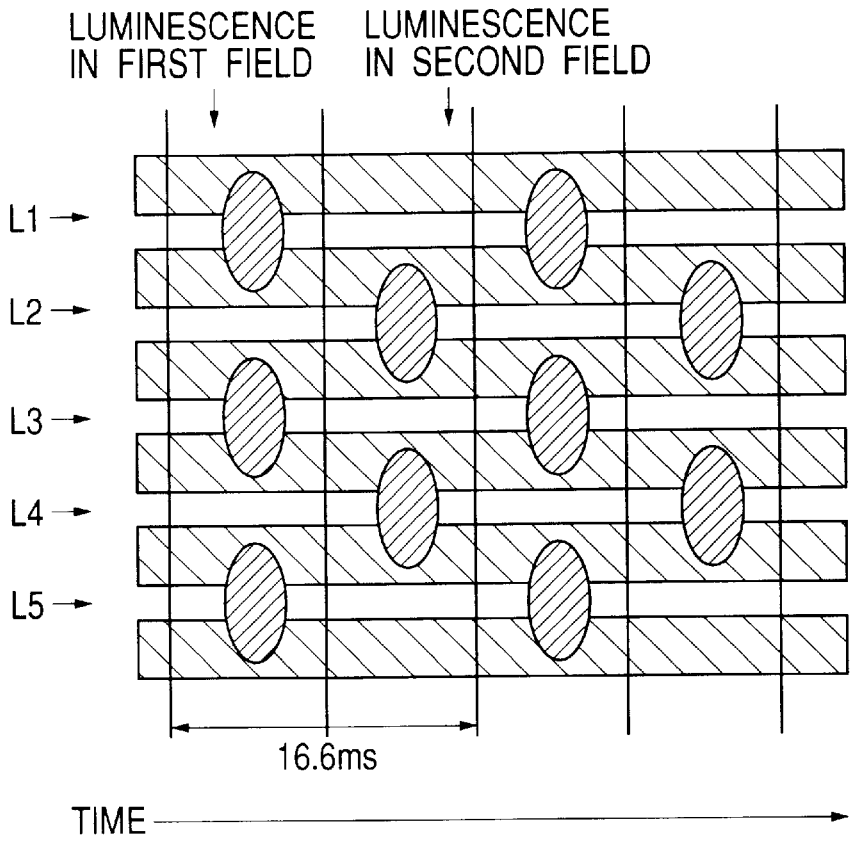
FIG. 9 is a diagram illustrating a light-emission principle of a plasma display panel employing an ALIS method.
Figure 10:
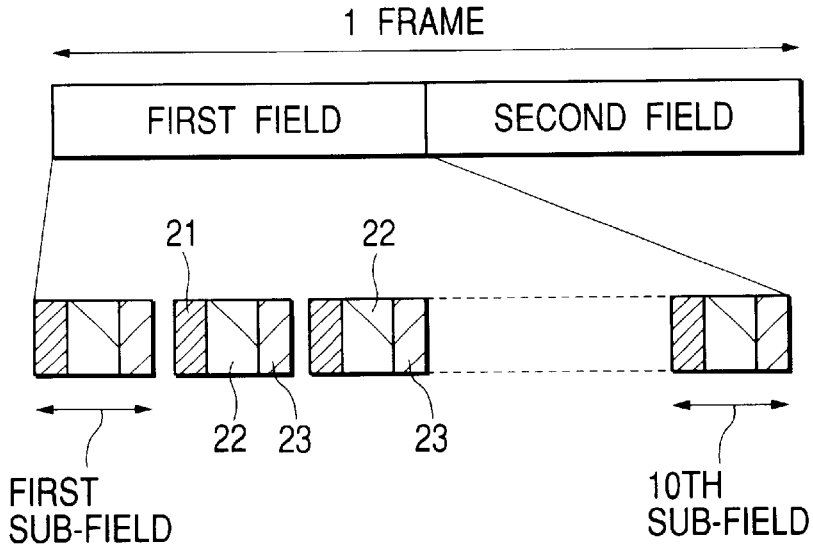
FIG. 10 is a diagram illustrating a sub-field structure in the driving method of the plasma display panel employing the ALIS method.
Figures 11A, 11B, 11C, 11D, 11E:
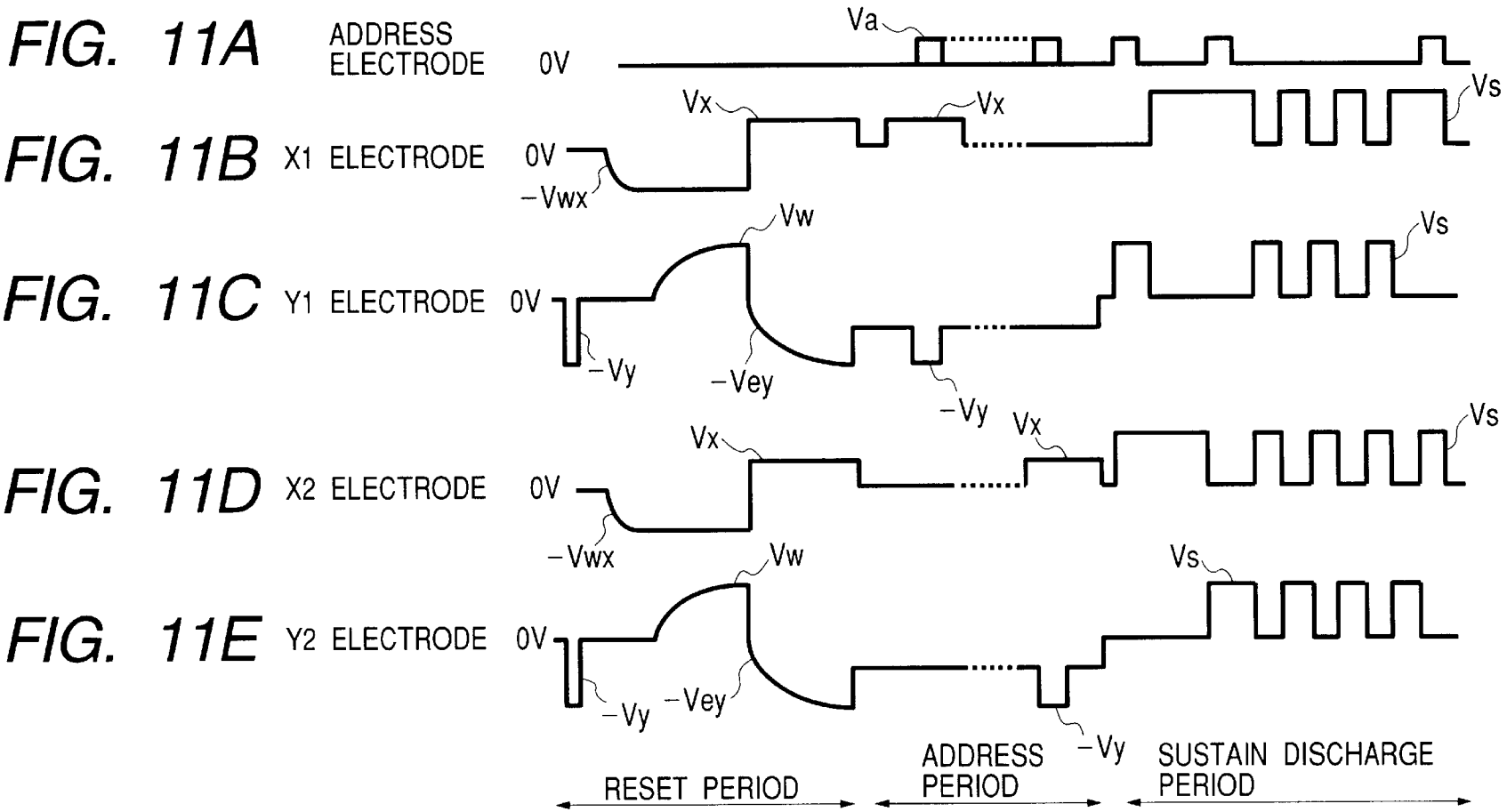
FIGS. 11A to 11E illustrate waveform diagrams of driving waveform applied to each electrode in the plasma display panel employing the ALIS method.
Figures 12A, 12B, 12C, 12D, 12E, 12F:
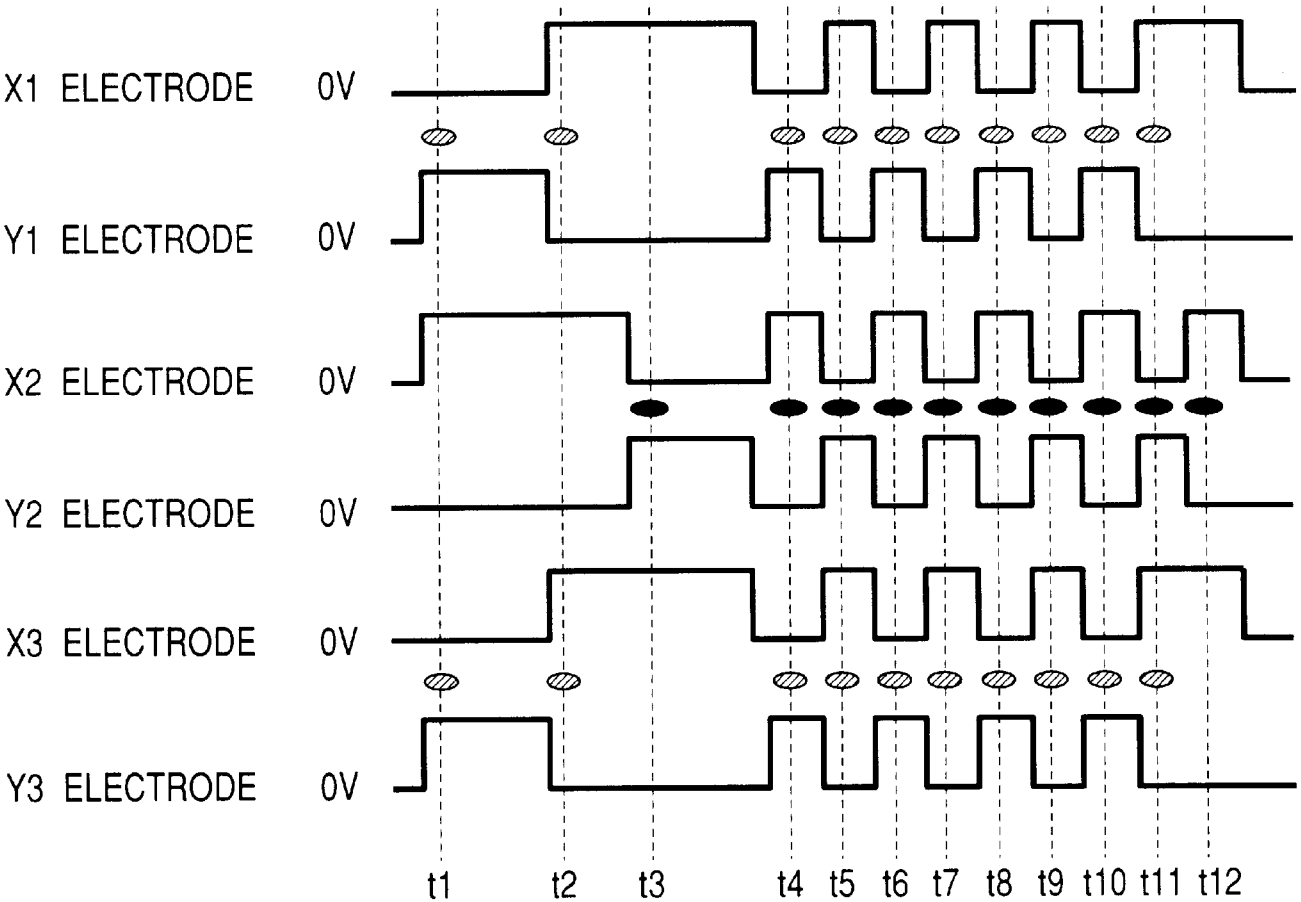
FIGS. 12A to 12F illustrate waveform diagrams of voltage applied to a plasma display panel during a sustain discharge period.
Figure 13A:
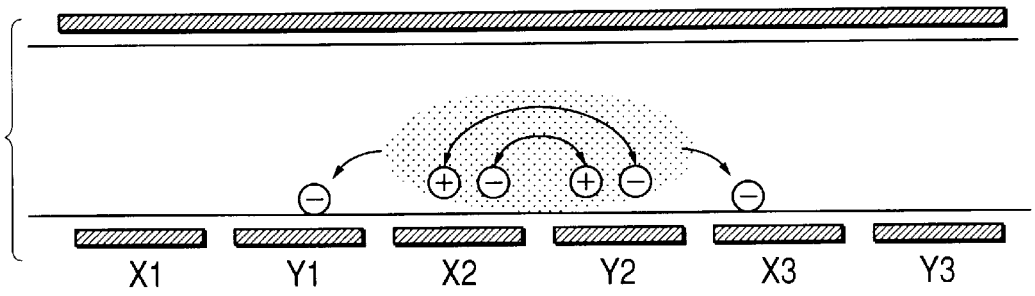
FIGS. 13A to 13D show diagrams illustrating operation of the plasma display panel employing the ALIS method.
Figure 13B:
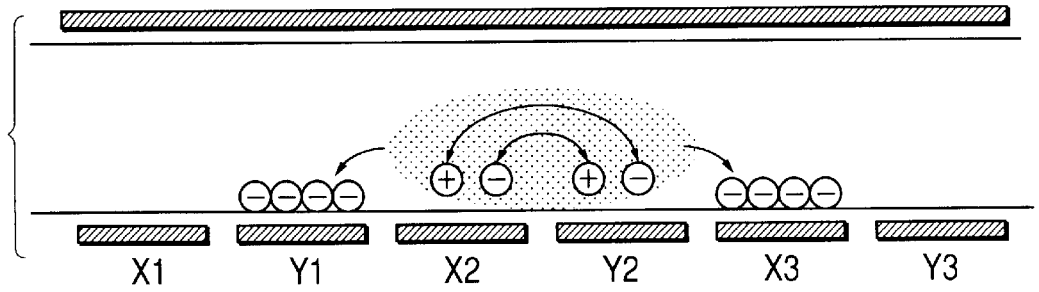
Figure 13C:
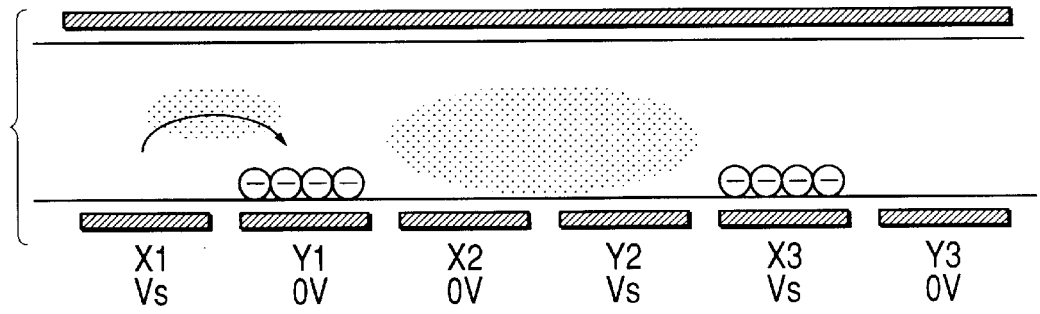
Figure 13D:
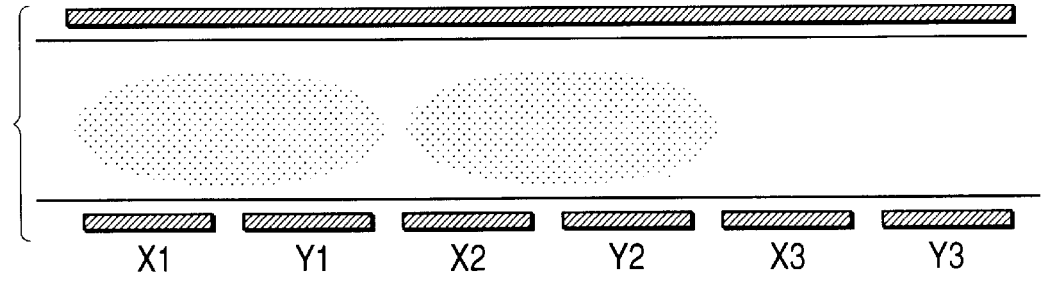

FIGS. 6A to 6E illustrate waveform diagrams of a driving method for a plasma display panel according to a fourth embodiment of the present invention, in which, FIG. 6A is a voltage waveform applied to the address electrode during the reset and charge adjustment period, the address period and the sustain discharge period; FIG. 6B is a voltage waveform applied to the X1 electrode during the reset and charge adjustment period, the address period and the sustain discharge period; FIG. 6C is a voltage waveform applied to the Y1 electrode during the reset and charge adjustment period, the address period and the sustain discharge period; FIG. 6D is a voltage waveform applied to the X2 electrode during the reset and charge adjustment period, the address period and the sustain discharge period; and FIG. 6E is a voltage waveform applied to the Y2 electrode during the reset and charge adjustment period, the address period and the sustain discharge period.

The present embodiment is characterized in that negative charges are formed in X and Y electrodes in all of cells during the reset period. The negative and positive charges are respectively accumulated in the X electrode side and the Y electrode side, by a writing pulse of a voltage waveform Vw having a gentle gradient, the voltage waveform being applied to the Y electrode (Y1, Y2 . . . Yn electrodes). Thereafter, while maintaining the voltage on the Y electrode, the voltage waveform Yx having a gradient as gentle as the voltage waveform Vw is applied to the X electrode (X1, X2, . . . Xn electrodes) as the writing pulse. By the voltage waveform Vx, a weak discharge occurred between the X electrode and the address electrode, so that the positive and negative (charges) are formed in the address electrode side and the X electrode side.

Subsequently, a negative eliminating pulse −Vey having a gentle gradient waveform is applied to the Y electrode, thus eliminating the wall charge. Because both of the Y electrode and the X electrode have negative charges thereon, a voltage Vx applied to the X electrode during an address step is slightly higher than the voltage shown in FIGS. 11A to 11E.

As such, since the negative charges are formed on X and Y electrode during a reset and charge adjustment step, it is possible to prevent a false discharge from occurring during the sustain discharge period.

Moreover, the present embodiment may be applied to a common plasma display panel and a plasma display panel using the ALIS method.

According to the present invention, it is possible to prevent an abnormal discharge or a false discharge from occurring in the un-illuminated cell adjacent to the illuminated cell during the sustain discharge period, thus contributing to improve a display quality. It is particularly effective to the ALIS method panel or a plasma display panel using a method in which a charge remains during the reset period.

The invention may be embodied in other specific forms without departing from the sprit or essential characteristics thereof. The present embodiment is therefore to be considered in all respects as illustrative and not restrictive, the scope of the invention being indicated by the appended rather than by the foregoing description and all changes which come within the meaning and range of equivalency of the claims are therefore intended to be embraced therein.

What is claimed is:

1. A driving method of a plasma display panel, the plasma display panel having a plurality of first electrodes, a plurality of second electrodes disposed alternately and parallel to the first electrodes, and a plurality of third electrodes disposed perpendicularly to the first and the second electrodes so as to provide intervals, the method comprising:

a step for resetting;

a step for address discharging;

a step for sustain: discharging; and a charge adjustment step for adjusting a wall charge for a cell having no address discharges occurred therein by applying a voltage for initiating a discharge between the third electrode and one of the first and the second electrodes in the cell having no address discharges occurred therein during either one of a period for the reset step and a period between a period for the address step and a period for the sustain discharge step.

2. A driving method of a plasma display panel according to claim 1, wherein a small amount of negative charges are accumulated in a vicinity of the first and the second electrodes in the cell having no address discharges occurred therein.

3. A driving method of a plasma display panel, the plasma display panel having a plurality of first electrodes, a plurality of second electrodes disposed alternately and parallel to the first electrodes, and a plurality of third electrodes disposed perpendicularly to the first and the second electrodes so as to provide intervals, the method comprising:

a step for resetting;

a step for address discharging;

a step for sustain discharging; and a charge adjustment step for adjusting a wall charge for a cell having no address discharges occurred therein by applying a voltage for initiating a discharge between the third electrode and one of the first and the second electrodes in the cell having no address discharges occurred therein.

4. A driving method of a plasma display panel according to claim 3, wherein the sustain discharge occurs one time in a cell in which the address discharge is initiated in the address step, and the charge adjustment step is initiated thereafter.

5. A driving method of a plasma display panel according to claim 3, wherein the charge adjustment step applies a voltage to initiate a discharge in the cell in which the address discharge has not occurred by using the third electrode as a cathode and either one of the first and the second electrodes as an anode.

6. A driving method of a plasma display panel according to claim 5, wherein in the charge adjustment step, another one of the first and second electrodes has a voltage that does not initiate a discharge between the address electrode and the one of the first and the second electrodes.

7. A driving method of a plasma display panel according to claim 3, wherein in the charge adjustment step, a polarity between the first and the second electrodes is a reversed polarity of a waveform that initiates a discharge between the first and the second electrodes at the end of the step for resetting.

8. A driving method of a plasma display panel according to claim 3, wherein the charge adjustment step is provided in at least one of a plurality of sub-fields within a field or a frame.

9. A driving method of a plasma display panel according to claim 3, wherein the charge adjustment step is provided in a sub-field having a large number of times of sustain discharge.

10. A driving method of a plasma display panel according to claim 3, wherein the charge adjustment step is provided in the first sub-field in the field.

11. A driving method of a plasma display panel according claim 3, wherein the voltage for initiating the discharge between the third electrode and the one of the first and second electrodes in the charge adjustment step has a voltage waveform having a gentle gradient.

12. A driving method of a plasma display panel according to claim 3, wherein electrons are formed on both the first and the second electrodes in the charge adjustment step.

13. A driving method of a plasma display panel, the plasma display panel comprising a plurality of first electrodes, a plurality of second electrodes disposed alternately and parallel to the first electrodes, and a plurality of third electrodes disposed perpendicularly to the first and the second electrodes so as to provide intervals, the method comprising:

a step for resetting;

a step for address discharging; and a step for sustain discharging;

wherein a charge adjustment step is provided in the step for resetting so than electrons remain both on the first electrode side and the second electrode side.

14. A plasma display panel, comprising:

a plurality of first electrodes;

plurality of second electrodes disposed alternately and to first electrodes;

a plurality of third electrodes disposed perpendicularly to the first and the second electrodes so as to provide intervals;

a first driving circuit for supplying a voltage waveform to the first electrodes;

a second driving circuit for supplying a voltage waveform to the second electrodes; and a third driving circuit for supplying a voltage waveform to the third electrodes;

wherein, by voltages supplied from the respective first, second, and third driving circuits to the first, second, and third electrodes, a reset procedure, an address discharge procedure, and a sustain discharge procedure are conducted, and by applying a voltage for initiating a discharge between the third electrode and one of the first and the second electrodes in a cell in which the address discharge does not occur during one of a period for conducting the reset procedure and a period between a period for conducting the address discharge and a period for conducting the sustain discharge, a wall charge is adjusted with respect to the cell in which the address discharge does not occur.

15. A plasma display panel, comprising:

a plurality of first electrodes;

a plurality of second electrodes disposed alternately and parallel to the first electrodes;

a plurality of third electrodes disposed perpendicularly to the first and the second electrodes so as to provide intervals; and a driving circuit;

wherein the driving circuit conducts a reset step; an address discharge step; a charge adjustment step for adjusting a wall charge with respect to a cell in which the address discharge is not conducted, by applying a voltage which initiates a discharge between the third electrode and one of the first and the second electrodes; and a sustain discharge step.

16. A driving method of a plasma display panel, the plasma display panel having a plurality of first electrodes, a plurality of second electrodes disposed alternately and parallel to the first electrodes, a plurality third electrodes disposed perpendicularly to the first and the second electrodes so as to provide intervals, and a driving circuit for driving the first, second, and third electrodes; the method comprising:

a reset and charge adjustment step for making electrons remain in both of the first electrodes and the second electrodes;

an address discharge step; and a sustain discharge step.

* * * * *